US007948181B2

(12) United States Patent
Hong et al.

(10) Patent No.: US 7,948,181 B2
(45) Date of Patent: May 24, 2011

(54) PLASMA DISPLAY PANEL AND PLASMA DISPLAY DEVICE INCLUDING THE PLASMA DISPLAY PANEL

(75) Inventors: Chong-Gi Hong, Yongin-si (KR); Young-Soo Seo, Yongin-si (KR); Yong-Jun Kim, Yongin-si (KR); Ki-Jong Eom, Yongin-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 214 days.

(21) Appl. No.: 12/036,094

(22) Filed: Feb. 22, 2008

(65) Prior Publication Data

US 2008/0218081 A1 Sep. 11, 2008

(30) Foreign Application Priority Data

Mar. 8, 2007 (KR) ..... 10-2007-0022927

(51) Int. Cl.
*H01J 1/62* (2006.01)

(52) U.S. Cl. ..... 313/582; 313/586; 313/587

(58) Field of Classification Search ..... 313/582, 313/586, 587

See application file for complete search history.

(56) References Cited

U.S. PATENT DOCUMENTS

| | | | |
|---|---|---|---|
| 6,897,610 | B1 | 5/2005 | Aoki et al. |
| 7,109,658 | B2 | 9/2006 | Yoo et al. |
| 2005/0035713 | A1 | 2/2005 | Yoo |
| 2005/0040767 | A1 | 2/2005 | Yoo et al. |
| 2005/0179117 | A1 | 8/2005 | Lee |
| 2006/0125397 | A1 | 6/2006 | Min et al. |
| 2006/0175971 | A1 | 8/2006 | Yoo et al. |
| 2006/0208636 | A1 | 9/2006 | Kweon |
| 2006/0267499 | A1 | 11/2006 | Yoo et al. |
| 2007/0029933 | A1 | 2/2007 | Kweon |
| 2007/0152583 | A1 | 7/2007 | Hong et al. |
| 2007/0228963 | A1 | 10/2007 | Choo |
| 2007/0228967 | A1 | 10/2007 | Kim |
| 2007/0228976 | A1 | 10/2007 | Ko |
| 2008/0106180 | A1 | 5/2008 | Hong |

FOREIGN PATENT DOCUMENTS

CN 1909144 A 2/2007

(Continued)

OTHER PUBLICATIONS

European Search Report, dated May 21, 2007, corresponding to EP 06125652.5, in the name of Samsung SDI Co., Ltd.

(Continued)

*Primary Examiner* — Vip Patel
(74) *Attorney, Agent, or Firm* — Christie, Parker & Hale, LLP

(57) ABSTRACT

A plasma display panel includes a front substrate having a first color, a rear substrate facing the front substrate, barrier ribs disposed between the front and rear substrates and defining discharge cells, the barrier ribs having a second color, phosphor layers disposed in the discharge cells, display electrodes arranged on the front substrate and extending in a first direction, the discharge electrodes corresponding to the discharge cells, a dielectric layer disposed on the front substrate and covering the display electrodes, the dielectric layer having a third color, address electrodes arranged on the rear substrate and extending in a second direction crossing the first direction, the address electrodes corresponding to the discharge cells, and a filter disposed on the front substrate and having a fourth color. The first through fourth colors realize a subtractive color mixture through a complementary coloring with each other.

35 Claims, 11 Drawing Sheets

FOREIGN PATENT DOCUMENTS

| | | | |
|---|---|---|---|
| EP | 0 762 462 | A2 | 3/1997 |
| EP | 1 804 265 | A1 | 7/2007 |
| EP | 1 921 652 | A2 | 5/2008 |
| JP | 56-024740 | | 3/1981 |
| JP | 11-119664 | | 4/1999 |
| JP | 11-131059 | | 5/1999 |
| JP | 2000-267584 | | 9/2000 |
| JP | 2004-109545 | | 4/2004 |
| JP | 2005-063961 | | 3/2005 |
| JP | 2006-339142 | | 12/2006 |
| KR | 10-2004-0040048 | | 5/2004 |
| KR | 10-2004-0048173 | | 6/2004 |
| KR | 10-2005-0018072 | | 2/2005 |
| KR | 10-2005-0019213 | | 3/2005 |
| KR | 10-2005-0034186 | | 4/2005 |
| KR | 10-2006-0085305 | | 7/2006 |
| KR | 10-2007-0016359 | | 2/2007 |
| KR | 10-2007-0090561 | | 9/2007 |

OTHER PUBLICATIONS

Korean Office Action, dated Dec. 7, 2006, corresponding to KR 10-2005-0136233, in the name of Samsung SDI Co., Ltd.

Korean Patent Abstracts, Publication No. 1020040048173 A, Published on Jun. 7, 2004, in the name of Song, et al.

Korean Patent Abstracts, Publication No. 1020050019213 A, Published on Mar. 3, 2005, in the name of Kweon, et al.

Patent Abstracts of Japan for Publication No. 2006-339142 dated Dec. 14, 2006 in the name of Sung-Hune Yoo, et al.

Korean Patent Abstracts for Publication No. 1020050018072 dated Feb. 23, 2005 in the name of Sung Hune Yoo.

Korean Patent Abstracts for Publication No. 1020060085305 dated Jul. 26, 2006 in the name of Tae Joung Kweon.

Korean Patent Abstracts for Publication No. 1020070016359 dated Feb. 8, 2007 in the name of Tae Joung Kweon.

European Search Report dated Dec. 30, 2009, for European application 08101099.3, noting listed references in this IDS, as well as U.S. Publications 2006/0175971 and 2006/0267499, both previously filed in an IDS dated Dec. 22, 2009.

Yoo, Sung Hune, et al., *24.4:Invited Paper: The improvement of Ambient Contrast in Plasma Display Panel using Subtractive Mixture of Colors*, SID 06 Digest, vol. XXXVII, May 24, 2005, pp. 1217-1220, XP 007012699.

U.S. Office action dated Sep. 29, 2009, for related U.S. Appl. No. 11/868,391, noting listed references in this IDS.

Korean Registration Determination Certificate, dated Oct. 23, 2009, for priority Korean application 10-2007-0013310, noting listed reference in this IDS, as well as KR 10-2008-0041459, published subsequent to Feb. 22, 2008 subject U.S. application date.

PLASMA DISPLAY PANEL AND PLASMA DISPLAY DEVICE INCLUDING THE PLASMA DISPLAY PANEL

CROSS-REFERENCE TO RELATED APPLICATION

This application claims priority to and the benefit of Korean Patent Application No. 10-2007-0022927 filed in the Korean Intellectual Property Office on Mar. 8, 2007, the entire content of which is incorporated herein by reference.

BACKGROUND OF THE INVENTION

1. Field of the Invention

The present invention relates to a plasma display panel and, more particularly, to a plasma display panel that is designed to reduce or prevent the deterioration of the display quality due to an external light reflection.

2. Description of Related Art

A plasma display panel (PDP) is a display device that can display an image using red, green and blue visible light created by exciting phosphors using vacuum ultraviolet (VUV) rays emitted from plasma generated by the gas discharge.

The PDP can realize a large-sized screen over 60-inch with a thickness of only 10 cm. Like a cathode ray tube (CRT), the PDP is also a self-emissive display. Therefore, the color reproduction is excellent and there is no image distortion viewed from any angle. Furthermore, the PDP has advantages in terms of the manufacturing cost and productivity. As a result, the PDP has become prominent as an industrial flat display as well as a television.

In a conventional alternating current (AC) 3-electrode surface-discharge plasma display panel, a pair of electrodes is formed on the same surface of a front substrate and facing each other. Address electrodes are provided on a rear substrate spaced apart from the front substrate.

A plurality of discharge cells defined by barrier ribs are formed along crossed regions of the electrodes and the address electrodes are set between the front and rear substrates.

Millions or more of the discharge cells are arranged in a matrix pattern in the PDP. The PDP selects the discharge cells that will be turned on using a memory property of wall charges. The image is displayed by discharging the selected discharge cells.

While the image is displayed on a front surface of the PDP, external light emitted from a variety of external light sources is introduced into the PDP through the front surface.

Some of the light that is being introduced into the PDP is reflected and is mixed with visible light for displaying the image, thereby deteriorating the room contrast and the display quality.

SUMMARY OF THE INVENTION

Exemplary embodiments of the present invention provide a plasma display panel that can improve room contrast and display quality by forming a plurality of differently colored layers which realize complementary coloring and thus reducing an external light reflection through a subtractive color mixture of the differently colored layers. Exemplary embodiments of the present invention also provide a plasma display device including the plasma display panel.

According to an embodiment of the present invention, a plasma display panel includes a front substrate having a first color, a rear substrate facing the front substrate, barrier ribs disposed between the front and rear substrates and defining discharge cells, the barrier ribs having a second color, phosphor layers disposed in the discharge cells, display electrodes arranged on the front substrate and extending in a first direction, the display electrodes corresponding to the discharge cells, a dielectric layer disposed on the front substrate and covering the display electrodes, the dielectric layer having a third color, address electrodes arranged on the rear substrate and extending in a second direction crossing the first direction, the address electrodes corresponding to the discharge cells, and a filter disposed on the front substrate and having a fourth color, wherein a subtractive color mixture is realized by combination of the first through fourth colors.

Wherein, at least one of the first through fourth colors may be a chromatic color.

The adjacent colors among the first through fourth colors may be complementary with each other. The first and second colors may be respectively complementary with the third and fourth colors.

The first and second colors may be a blue color and the third and fourth colors may be an orange color. The front substrate and the barrier ribs each may be formed of a material including at least one of manganese (Mn), nickel (Ni), or cobalt (Co) while the filter and the dielectric layer each may be formed of a material including at least one of copper (Cu), antimony (Sb), or chrome (Cr).

The filter may include an electromagnetic shielding conductive layer, a protective filter covering the electromagnetic shielding conductive layer, and adhesive layers adhering the electromagnetic shielding conductive layer and the protective filter to each other and adhering the electromagnetic shielding conductive layer to the front substrate. The adhesive layers may be colored such that the filter has the fourth color. The adhesive layers may be formed of a material including at least one of copper (Cu), antimony (Sb), or chrome (Cr).

In another exemplary embodiment of the present invention, a plasma display panel includes a front substrate having a first color, a rear substrate facing the front substrate, the rear substrate having a second color, barrier ribs disposed between the front and rear substrates and defining discharge cells, the barrier ribs having a third color, phosphor layers disposed in the discharge cells, display electrodes arranged on the front substrate and extending in a first direction, the display electrodes corresponding to the discharge cells, a dielectric layer disposed on the front substrate and covering the display electrodes, the dielectric layer having a fourth color, address electrodes arranged on the rear substrate and extending in a second direction crossing the first direction, the address electrodes corresponding to the discharge cells, and a filter disposed on the front substrate and having a fifth color, wherein a subtractive color mixture is realized by combination of the first through fifth colors.

Wherein, at least one of the first through fifth colors may be a chromatic color.

The adjacent colors among the first through fifth colors may be complementary with each other. The first and third colors may be respectively complementary with the second, fourth and fifth colors.

The first and third colors may be a blue color and the second, fourth and fifth colors may be an orange color. The barrier ribs each may be formed of a material including at least one of manganese (Mn), nickel (Ni), or cobalt (Co) while the filter and the dielectric layer each may be formed of a material including at least one of copper (Cu), antimony (Sb), or chrome (Cr).\

The filter may include an electromagnetic shielding conductive layer, a protective filter covering the electromagnetic shielding conductive layer, and adhesive layers adhering the electromagnetic shielding conductive layer and the protective filter to each other and adhering the electromagnetic shielding conductive layer to the front substrate. The adhesive layers may be colored such that the filter has the fifth color.

In still another exemplary embodiment of the present invention, a plasma display panel includes a front substrate having a first color, a rear substrate facing the front substrate, the rear substrate having a second color, barrier ribs disposed between the front and rear substrates and defining discharge cells, the barrier ribs having a third color, phosphor layers disposed in the discharge cells, display electrodes arranged on the front substrate and extending in a first direction, the display electrodes corresponding to the discharge cells, an upper dielectric layer disposed on the front substrate and covering the display electrodes, the upper dielectric layer having a fourth color, a passivation layer covering the upper dielectric layer and having a fifth color, address electrodes arranged on the rear substrate and extending in a second direction crossing the first direction, the address electrodes corresponding to the discharge cells, and a lower dielectric layer covering the address electrodes on the rear substrate and having a sixth color, wherein a subtractive color mixture is realized by combination of the first through sixth colors.

Wherein, at least one of the first through sixth colors may be a chromatic color.

The adjacent colors among the first through sixth colors may be complementary with each other. The first, fifth and sixth colors may be respectively complementary with the second, third and fourth colors.

The first, fifth and sixth colors may be a blue color while he second, third and fourth colors may be an orange color.

The front substrate, the passivation layer and the lower dielectric layer each may be formed of a material including at least one of manganese (Mn), nickel (Ni), or cobalt (Co). The upper dielectric layer and the barrier ribs each may be formed of a material including at least one of copper (Cu), antimony (Sb), or chrome (Cr).

In still yet another exemplary embodiment of the present invention, a plasma display panel includes a front substrate having a first color, a rear substrate facing the front substrate, the rear substrate having a second color, barrier ribs disposed between the front and rear substrates, the barrier ribs defining discharge cells, phosphor layers disposed in the discharge cells, display electrodes arranged on the front substrate and extending in a first direction, the display electrodes corresponding to the discharge cells, an upper dielectric layer disposed on the front substrate and covering the display electrodes, address electrodes arranged on the rear substrate and extending in a second direction crossing the first direction, the address electrodes corresponding to the discharge cells, and a lower dielectric layer covering the address electrodes on the rear substrate, the lower dielectric layer having a third color, wherein the barrier ribs include a first barrier rib layer contacting the lower dielectric layer and having a fourth color and a second barrier rib layer disposed on the first barrier rib layer and having a fifth color, the upper dielectric layer includes a first upper dielectric layer contacting the front substrate and having a sixth color and a second upper dielectric layer covering the first upper dielectric layer and having a seventh color, wherein a subtractive color mixture is realized by combination of the first through seventh colors.

Wherein, at least one of the first through seventh colors may be a chromatic color.

The adjacent colors among the first through seventh colors may be complementary with each other. The first, second, third, and sixth colors may be respectively complementary with the fourth, fifth and seventh colors.

The first, second, third, and sixth colors may be a blue color and the fourth, fifth and seventh colors may be an orange color.

The front substrate, the rear substrate, the first barrier layers, and the second upper dielectric layer each may be formed of a material including at least one of manganese (Mn), nickel (Ni), or cobalt (Co), and the second barrier rib layer, the first upper dielectric layer and the lower dielectric layer each may be formed of a material including at least one of copper (Cu), antimony (Sb), or chrome (Cr).

BRIEF DESCRIPTION OF THE DRAWINGS

A more complete appreciation of the present invention and many of the features and aspects thereof, will be readily apparent as the present invention becomes better understood by reference to the following detailed description when considered in conjunction with the accompanying drawings in which like reference symbols indicate like components, wherein.

DETAILED DESCRIPTION OF THE EMBODIMENTS

The present invention will now be described more fully with reference to the accompanying drawings, in which exemplary embodiments of the invention are shown. The invention may, however, be embodied in many different forms and should not be construed as being limited to the embodiments set forth herein; rather these embodiments are provided so that this disclosure will be thorough and complete, and will fully convey the concept of the invention to those skilled in the art. Wherever possible, the same reference numbers will be used throughout the drawings to refer to the same or like parts.

Figure 1:
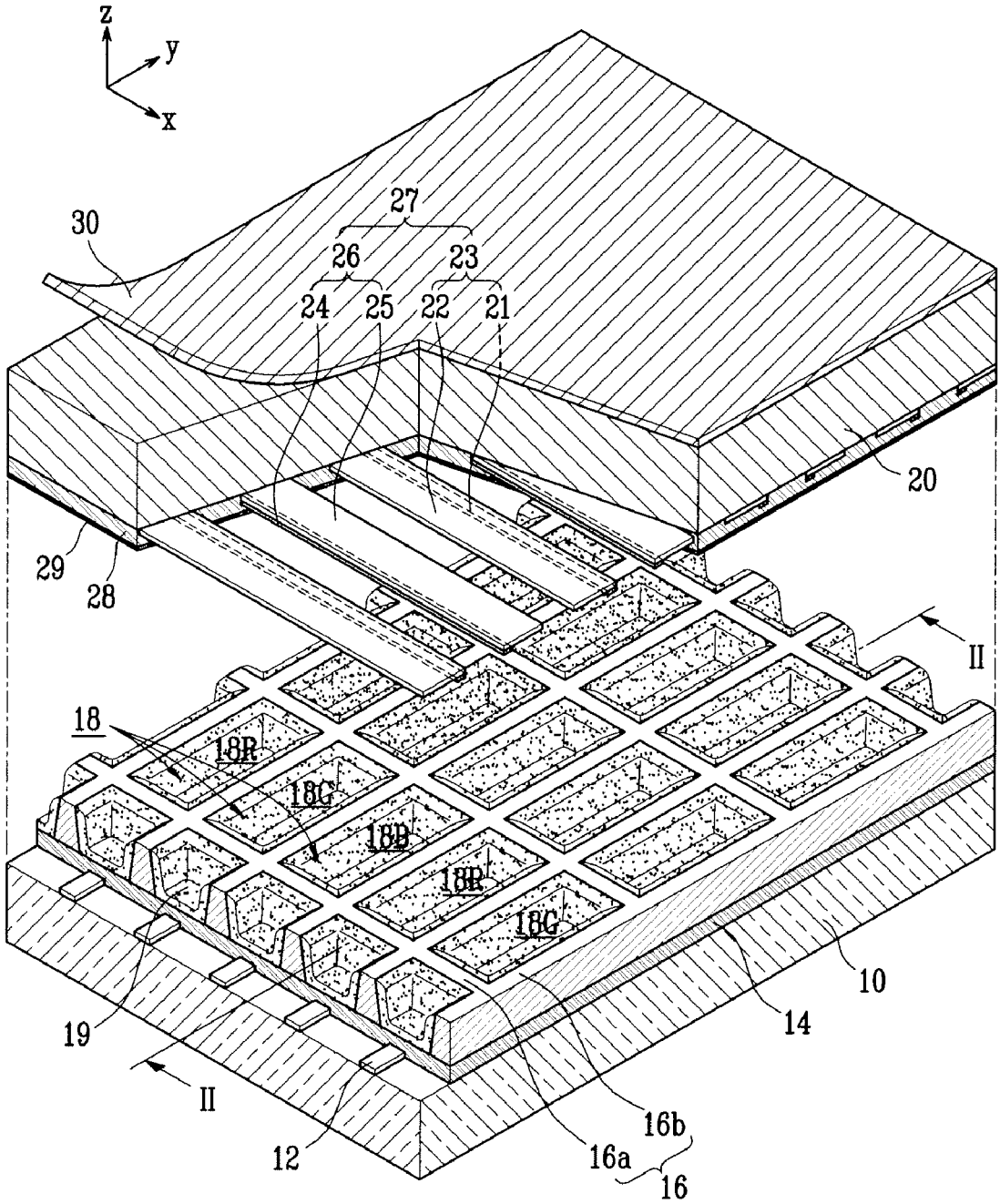
FIG. 1 is a partly cut-away perspective view of a plasma display panel according to a first exemplary embodiment of the present invention.
Figure 2:
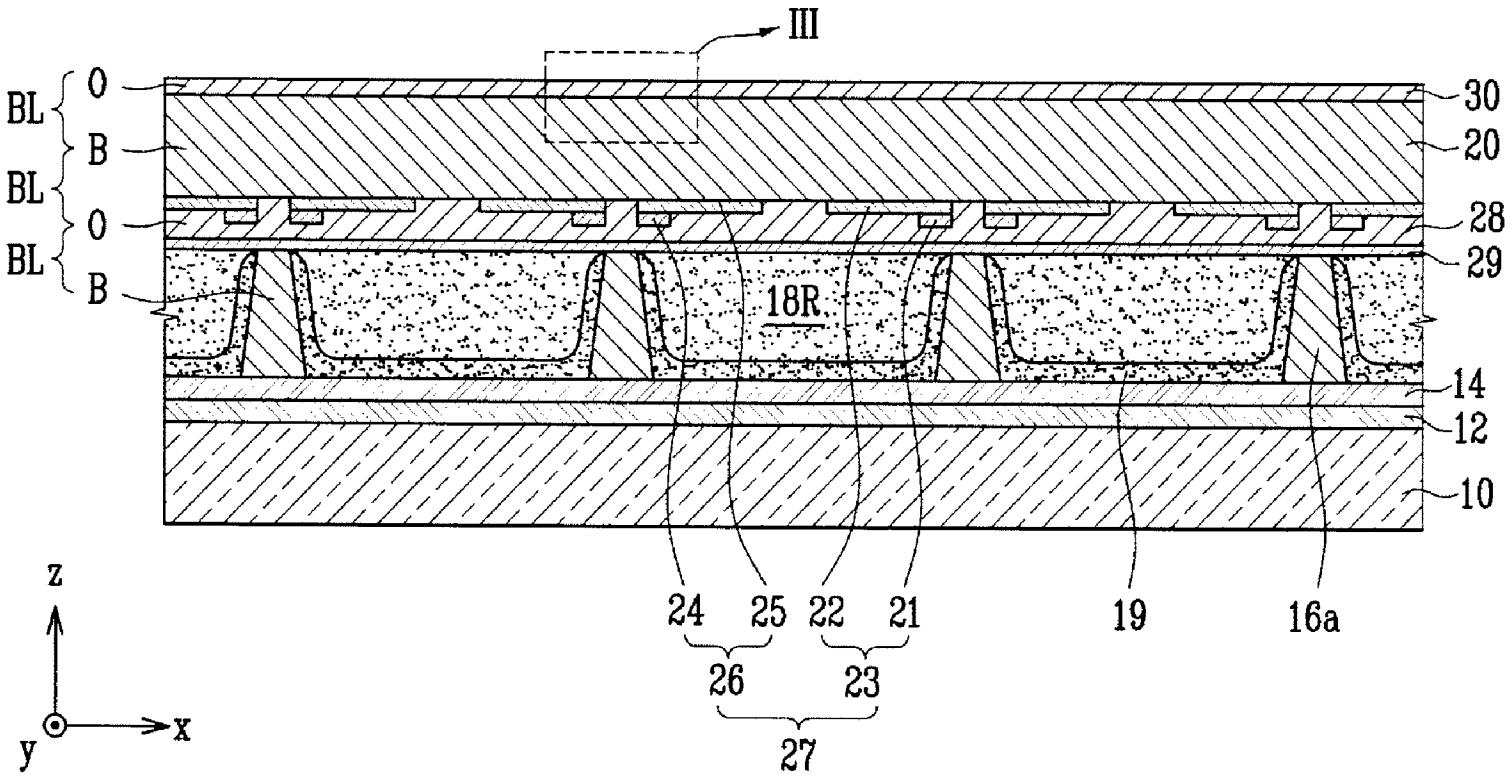
FIG. 2 is a sectional view taken along the line II-II of FIG. 1.

FIG. 1 is a partly cut-away perspective view of a plasma display panel according to a first exemplary embodiment of the present invention and FIG. 2 is a sectional view taken along the line II-II of FIG. 1.

Referring to FIGS. 1 and 2, a plasma display panel includes rear and front substrates 10 and 20 facing each other at an interval or gap, which may be predetermined.

The rear and front substrates 10 and 20 are sealed together at their peripheries using a frit member (not shown). A plurality of discharge cells 18 are defined by barrier ribs 16 between the rear and front substrates 10 and 20.

The front substrate 20 is colored with a first color in order to realize a subtractive mixing with other colored layers and thus to reduce or prevent the reflection of an external light.

In the present embodiment, a case where the first color of the front substrate 20 is a blue color is described as an example. In this case, the front substrate 20 may be formed of a transparent glass mixed with a coloring agent such as manganese (Mn), nickel (Ni), or cobalt (Co).

The barrier ribs 16 include longitudinal barrier ribs 16*b* extending in a first direction (a y-axis in FIG. 1) and lateral barrier ribs 16*a* extending in a second direction (an x-axis in FIG. 1) perpendicularly crossing the longitudinal barrier ribs 16*b*. Therefore, the discharge cells 18 defined by the longitudinal and lateral barrier ribs 16*b* and 16*a* are arranged in a matrix pattern.

However, the plasma display panel of the present invention is not limited to the above. That is, the discharge cells 18, defined by the barrier ribs, may be arranged in a variety of patterns such as a stripe pattern or a delta pattern.

The barrier ribs 16 are colored with a second color. In this embodiment, a case where the second color is same as the first color is described as an example. That is, the second color may be a blue color. Therefore, the barrier ribs 16 may be formed of a dielectric substance mixed with one or more of blue coloring agents such as manganese (Mn), nickel (Ni), and cobalt (Co).

The discharge cells 18 are filled with a discharge gas (e.g., mixture gas including neon (Ne) and xenon (Xe)) to create vacuum ultraviolet rays using a gas discharge. The discharge cells 17 have phosphor layers 19 for absorbing the vacuum ultraviolet rays and emitting visible light.

In one embodiment, the phosphor layers 19 formed in the discharge cells 18 arranged along the y-axis are formed of phosphors of an identical color. In addition, the phosphor layers 19 formed in the discharge cells 18 arranged along the x-axis are formed of red, green, and blue phosphors R, G and B that are alternately placed.

In order to display an image using a gas discharge, the plasma display panel includes address electrodes 12 arranged on the rear substrate 10 and extending in a first direction (i.e., the y-direction) and correspond to the discharge cells 18 and a plurality of display electrodes 27 arranged on the front substrate 20 and extending in a second direction crossing the address electrodes 12.

Each of the display electrodes 27 includes a pair of scan and sustain electrodes 23 and 26 extending in parallel in the second direction (i.e., the x-direction) crossing the address electrode 12.

The scan and sustain electrodes 23 and 26 are covered by an upper dielectric layer 28. The upper dielectric layer 28 is colored by a third color.

In this embodiment, a case is shown where the third color is an orange color that is complementary with the first color of the front substrate 20 and the second color of the barrier ribs 16.

Therefore, the upper dielectric layer 28 is formed of a dielectric substance mixed with an orange coloring agent of an orange color. For example, the orange coloring agent may include at least one of copper (Cu), antimony (Sb), or chrome (Cr).

In the embodiment shown in FIG. 1, a passivation layer 29 is formed on the upper dielectric layer 28 to protect the dielectric layer 28 from the plasma discharge occurring in the discharge cells 18.

The passivation layer 29 may be a MgO layer having a relatively high visible light transmittance and a relatively high secondary electron emission coefficient. The MgO layer may reduce a firing voltage while protecting the upper dielectric layer 28.

The scan and sustain electrodes 23 and 26 respectively include bus electrodes 21 and 24 extending along the lateral barrier ribs 16*a* and transparent electrodes 22 and 25 extending in a second direction and having a width defined from the bus electrode 21 and 24, respectively, toward a center of the corresponding discharge cells.

The transparent electrodes 22 and 25 are arranged on the front substrate 20 in a stripe pattern extending in the second direction to correspond to the red, green and blue discharge cells 18R, 18G and 18B. The transparent electrodes 22 and 25 may be formed of indium-tin oxide (ITO) so as not to block out the visible light.

However, the present invention is not limited to the above case. For example, the transparent electrodes 22 and 25 may individually protrude from the bus electrodes 21 and 24 and correspond to the red, green and blue discharge cells 18R, 18G and 18B. By way of example, the transparent electrodes 22 and 25 may each include a plurality of protrusion electrodes extending from the bus electrodes 21 and 24, respectively, toward the center of the corresponding discharge cell. This way, each discharge cell has a corresponding pair of protrusion electrodes.

In order to compensate for a voltage drop caused by the transparent electrodes, the bus electrodes 21 and 24 are formed of a nontransparent material such as silver (Ag) that is relatively inexpensive and excellent in electrical conductivity.

In order to increase the transmittance of visible light, that is emitted from the discharge cells 18 by the plasma discharge, the bus electrodes 21 and 24 may be located close to the longitudinal barrier ribs 16*a* between which the corresponding discharge cells 18 are arranged. Furthermore, the bus electrodes 21 and 24 may be located along the top of the longitudinal barrier ribs 16*a*.

The address electrodes 12 are covered by the lower dielectric layer 14 and are formed on the rear substrate 10. The lower dielectric layer 14 protects the address electrodes 12 from the plasma discharge and accumulates electric charges. The barrier ribs 16 are formed on the lower dielectric layer 14.

Therefore, The plasma display panel selects discharge cells 18 that will be turned on by the address discharge occurring by the interaction between the address and scan electrodes 12 and 23 and drives the selected discharge cells 18 using the sustain discharge occurring by the interaction between the sustain and scan electrodes 23 and 26, thereby displaying an image.

A filter 30 is attached on the front substrate 20 on which the image is displayed. The filter 30 shields electromagnetic interference (EMI), which is discharged through the front substrate 20 when the plasma display panel is operated.

In order to reduce or prevent external light from being reflected, the filter 30 is colored with a fourth color. The fourth color may be orange color that is complementary with the first color of the front substrate.

Figure 3:
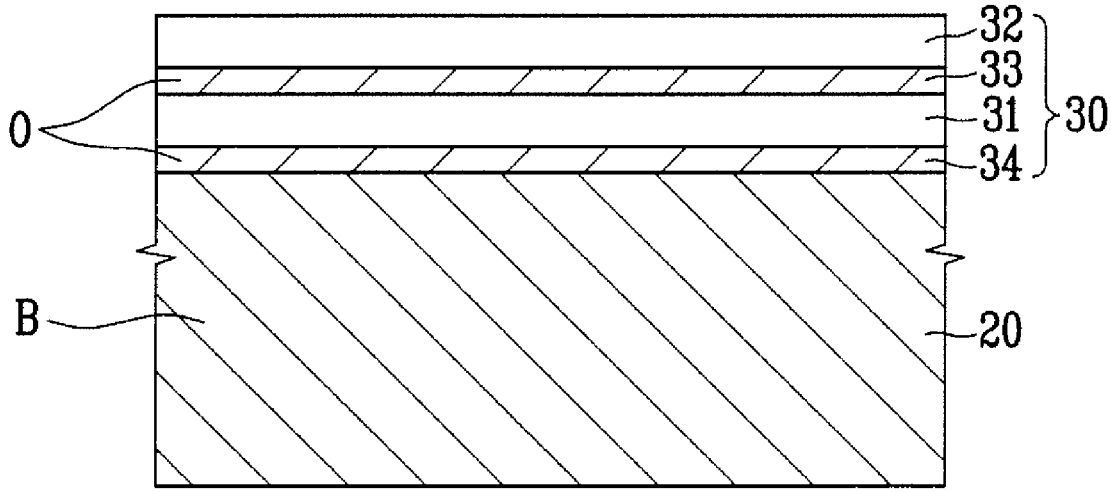
FIG. 3 is an enlarged side sectional view of a portion III of FIG. 2.

FIG. 3 is an enlarged side sectional view of a portion III of FIG. 3.

Referring to FIG. 3, the filter 30 includes an electromagnetic shielding conductive layer 31, a protective filter 32 covering the electromagnetic shielding conductive layer 31, and adhesive layers 33 and 34 for adhering the electromagnetic shielding conductive layer 31 and the protective filter 32 to each other and to the front substrate 20. The adhesive layers 33 and 34 are colored with the fourth color in the embodiment illustrated in FIG. 3, for example.

The electromagnetic shielding conductive layer 31 is attached on the front substrate 20 to ground the EMI, which is generated when the plasma display panel is driven, to a chassis base (not shown) and a casing (not shown) surrounding the plasma display panel and the chassis base through a metal grounding plate (not shown).

The electromagnetic shielding conductive layer 31 may be an ITO layer or a copper mesh. This process is well known in the art and thus the detailed description will be omitted herein.

The protective filter 32 protects the electromagnetic shielding conductive layer 31 by covering the same. Further, the protective filter 32 has been configured to maintain an overall outer appearance of the filter 30.

The adhesive layer 33 adheres the electromagnetic shielding conductive layer 31 to the protective filter 32. The adhesive layer 34 adheres the electromagnetic shielding conductive layer 31 to the front substrate 20.

At least one of the adhesive layers 33 or 34 may be colored with the orange color O that is the fourth color. Alternatively, the adhesive layers 33 and 34 may be colored with different colors such that the filter 30 that can represent the orange color by a mixture of the different colors.

In the embodiment illustrated in FIG. 3, both of the adhesive layers 33 and 34 are colored with the orange color. Therefore, the adhesive layers 33 and 34 may be formed of a transparent adhesive material mixed with an orange coloring agent. For example, the orange coloring agent may include at least one of copper (Cu), antimony (Sb), or chrome (Cr).

Accordingly, the plasma display panel of the first exemplary embodiment can realize a subtractive color mixture through the triple complementary coloring between the colors of the filter 30, front substrate 20, upper dielectric layer 28, and barrier ribs 16.

That is, the fourth color (orange color O) of the filter 30 is primarily complementary with the first color (blue color B) of the front substrate 20 to realize the subtractive color mixture. The first color (blue color B) of the front substrate 20 is secondarily complementary with the third color (orange color O) of the upper dielectric layer 28 to realize the subtractive color mixture. In addition, the third color (orange color O) of the upper dielectric layer 28 is thirdly complementary with the second color (blue color B) of the barrier ribs 16 to realize the subtractive color mixture.

In the plasma display panel of the first exemplary embodiment, the adjacent colors of the filter 30, front substrate 20, upper dielectric layer 28, and barrier ribs 16 are subtractive-mixed with each other through the triple complementary coloring, thereby enhancing a light absorption rate of the plasma display panel and thus reducing the external light reflection.

In this embodiment, a case where the front substrate 20 and the barrier ribs 16 are colored with the blue color and the upper dielectric layer 28 and the filter 30 are colored with the orange color is illustrated as an example.

However, the present invention is not limited to the above case. For instance, in other embodiments, the front substrate 20 and the barrier ribs 16 may be colored with the orange color O, and the upper dielectric layer 28 and the filter 30 may be colored with the blue color B. In addition, a variety of other colors that are complementary may be applied.

Figure 4:
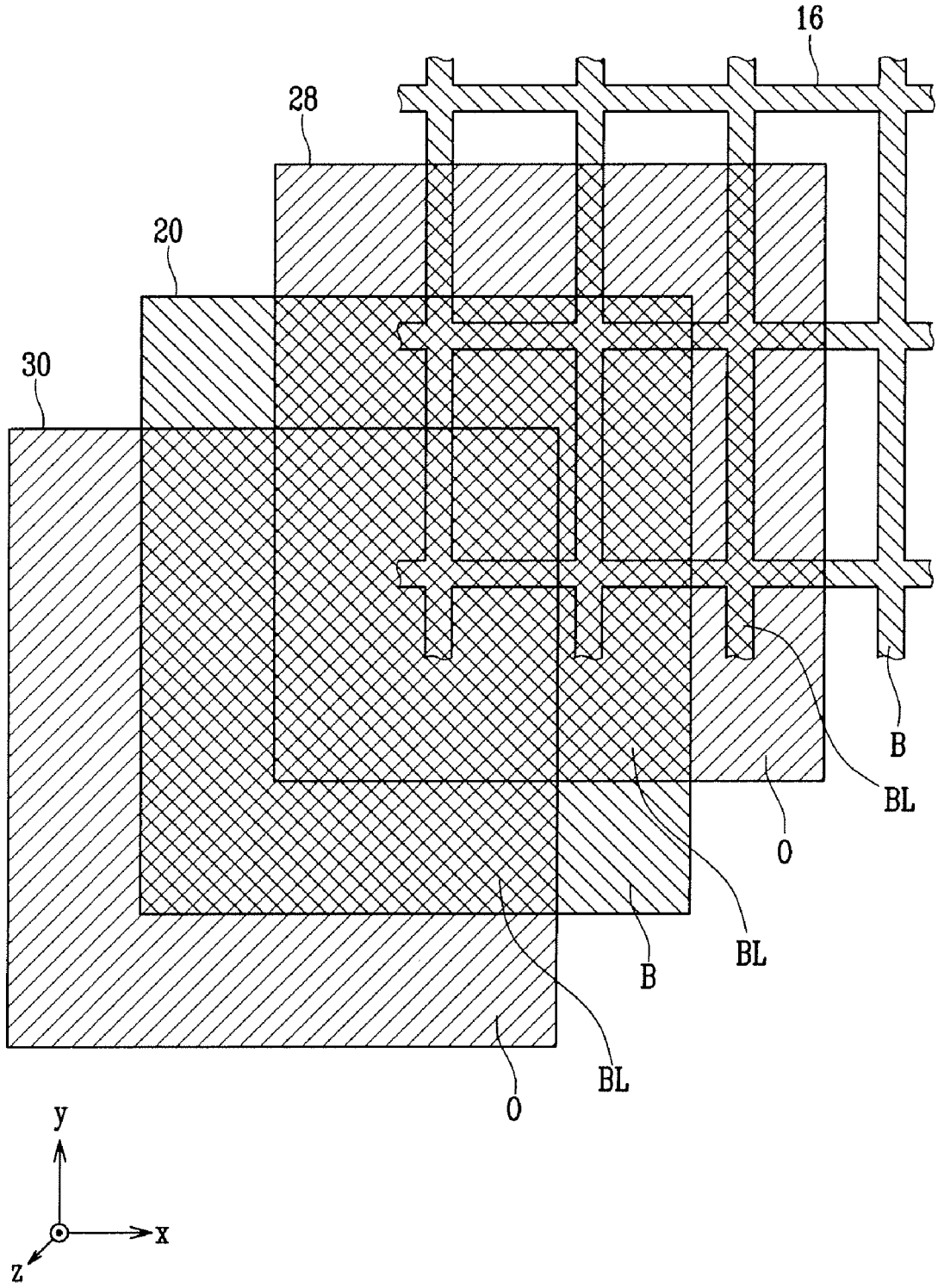
FIG. 4 is a schematic view illustrating a subtractive color mixing state when a filter, front substrate, upper dielectric layer, and barrier ribs of the plasma display panel of FIG. 3 are overlapped with each other.

FIG. 4 is a top plane view illustrating a subtractive color mixing state when the filter 30, front substrate 20, upper dielectric layer 28, and barrier ribs 16 of the plasma display panel of the present embodiment are overlapped with each other.

Referring to FIG. 4, when the plasma display panel of this embodiment is viewed from a front side, the adjacent colors of the filter 30, front substrate 20, upper dielectric layer 28, and barrier ribs 16 are subtractive-mixed with each other through the triple complementary coloring.

That is, when the filter 30 and the front substrate 20 are overlapped with each other, the fourth color of the filter 30 and the first color of the front substrate 20 are subtractive-mixed with each other. That is, the orange color O that is the fourth color is primarily complementary with the blue color that is the first color to realize the subtractive color mixture, thereby together appearing as a black color BL.

In addition, the first color (blue color B) of the front substrate 20 is secondarily complementary with the third color (orange color O) of the upper dielectric layer 28 to realize the subtractive color mixture, thereby together appearing as the black color BL.

Further, the third color (orange color O) of the upper dielectric layer 28 is thirdly complementary with the second color (blue color B) of the barrier ribs 16 to realize the subtractive color mixture, thereby together appearing as the black color BL.

As described above, in the plasma display panel of the present embodiment, the adjacent colors of the filter 30, front substrate 20, upper dielectric layer 28, and barrier ribs 16 are subtractive-mixed with each other through the triple complementary coloring, thereby together appearing as the black color BL. Therefore, the external light absorption rate increases and the external light reflection is reduced or prevented.

Particularly, since the fourth color of the filter 30 is subtractive-mixed with the first color of the front substrate 20 to together appear black at the front surface of the display electrodes 27, the reflection of the external light from the bus electrodes 21 and 24 that are nontransparent white layers formed of metal such as Ag can be reduced or prevented.

The filter of this embodiment is not provided with an external light reflection-preventing layer of a conventional filter. That is, instead of using the external light reflection preventing layer, the adhesive layers 33 and 34 of the filter 30 are colored with the orange color O that can be subtractive-mixed with the blue color B of the front substrate 20, thereby preventing the external light from being reflected, or reducing the reflection of such external light.

Accordingly, as the filter 30 can prevent the external light reflection or reduce the reflection of such external light without using the external light reflection-preventing layer, the manufacturing process of the filter and the plasma display panel using the filter can be simplified and the manufacturing cost thereof is reduced.

The following will described a plasma display panel according to a second exemplary embodiment of the present invention with reference to the accompanying drawings. In this second exemplary embodiment, the same or like parts as those of the first exemplary embodiment will be assigned with the same reference numbers and the detailed description thereof will be omitted herein.

Figure 5:
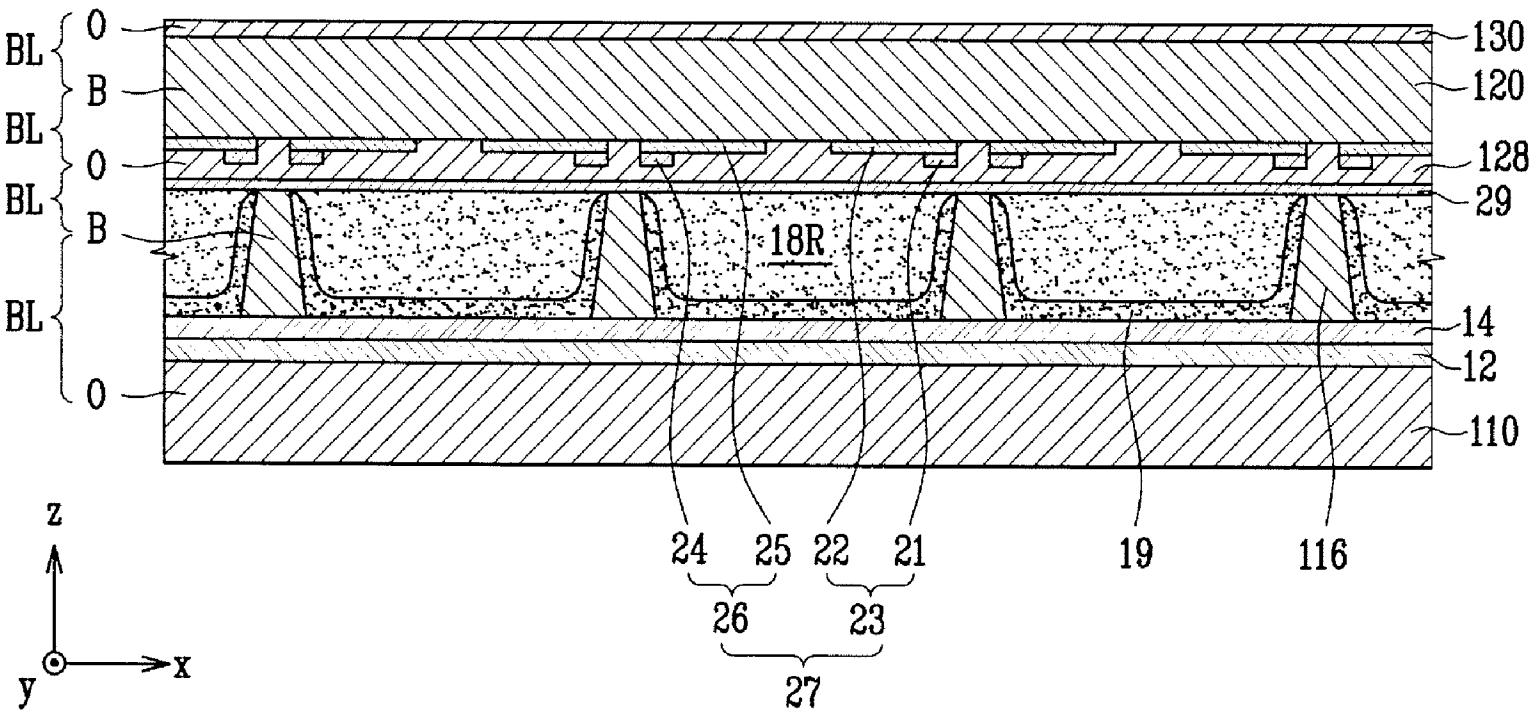
FIG. 5 is a sectional view of a plasma display panel according to a second exemplary embodiment of the present invention.

FIG. 5 is a sectional view of a plasma display panel according to the second exemplary embodiment of the present invention.

Referring to FIG. 5, a plasma display panel includes front and rear substrates 120 and 110 facing each other. The front and rear substrates 120 and 110 are respectively colored with first and second colors, e.g., a blue color B and an orange color O.

In one embodiment, the rear substrate 110 is formed of a transparent glass material mixed with an orange color coloring agent such as copper (Cu), antimony (Sb) or chrome (Cr).

Barrier ribs 116 disposed between the front and rear substrates 120 and 110, and defining the discharge cells 18, are colored with a third color (e.g., the blue color B).

An upper dielectric layer 128 covering display electrodes 27 on the front substrate 120 is colored with a fourth color (e.g., the orange color O).

A filter 130 attached on a front surface of the front substrate 120 is colored with a fifth color. The filter 130 includes an electromagnetic shielding conductive layer 31, a protective filter 32 covering the electromagnetic shielding conductive layer 31, and adhesive layers 33 and 34 for adhering the electromagnetic shielding conductive layer 31 and the protective filter 32 to each other. (See FIG. 3, for example).

At least one of the adhesive layers 33 or 34 is colored with the fifth color (i.e., the orange color O).

Accordingly, the plasma display panel of the second exemplary embodiment can realize a subtractive color mixture through the quadruple complementary coloring between the colors of the filter 130, front substrate 120, upper dielectric layer 128, barrier ribs 116 and rear substrate 110.

That is, the fifth color (orange color O) of the filter 130 is primarily complementary with the first color (blue color B) of the front substrate 120. The first color (blue color B) of the front substrate 120 is secondarily complementary with the fourth color (orange color O) of the upper dielectric layer 128.

In addition, the fourth color (orange color O) of the upper dielectric layer 128 is thirdly complementary with the third color (blue color B) of the barrier ribs 116 and the third color (blue color B) of the barriers 116 is fourthly complementary with the second color (orange color O) of the rear substrate 110.

In this embodiment, the front substrate 120 and barrier ribs 116 are colored with the blue color and the upper dielectric layer 128, filter 130 and rear substrate 110 are colored with the orange color.

However, the present invention is not limited to the above case. For instance, in other embodiments, the front substrate 120 and barrier ribs 116 may be colored with the orange color O, and the upper dielectric layer 128, filter 130 and rear substrate 110 may be colored with the blue color B. In addition, a variety of other colors that are complementary may be applied.

Figure 6:
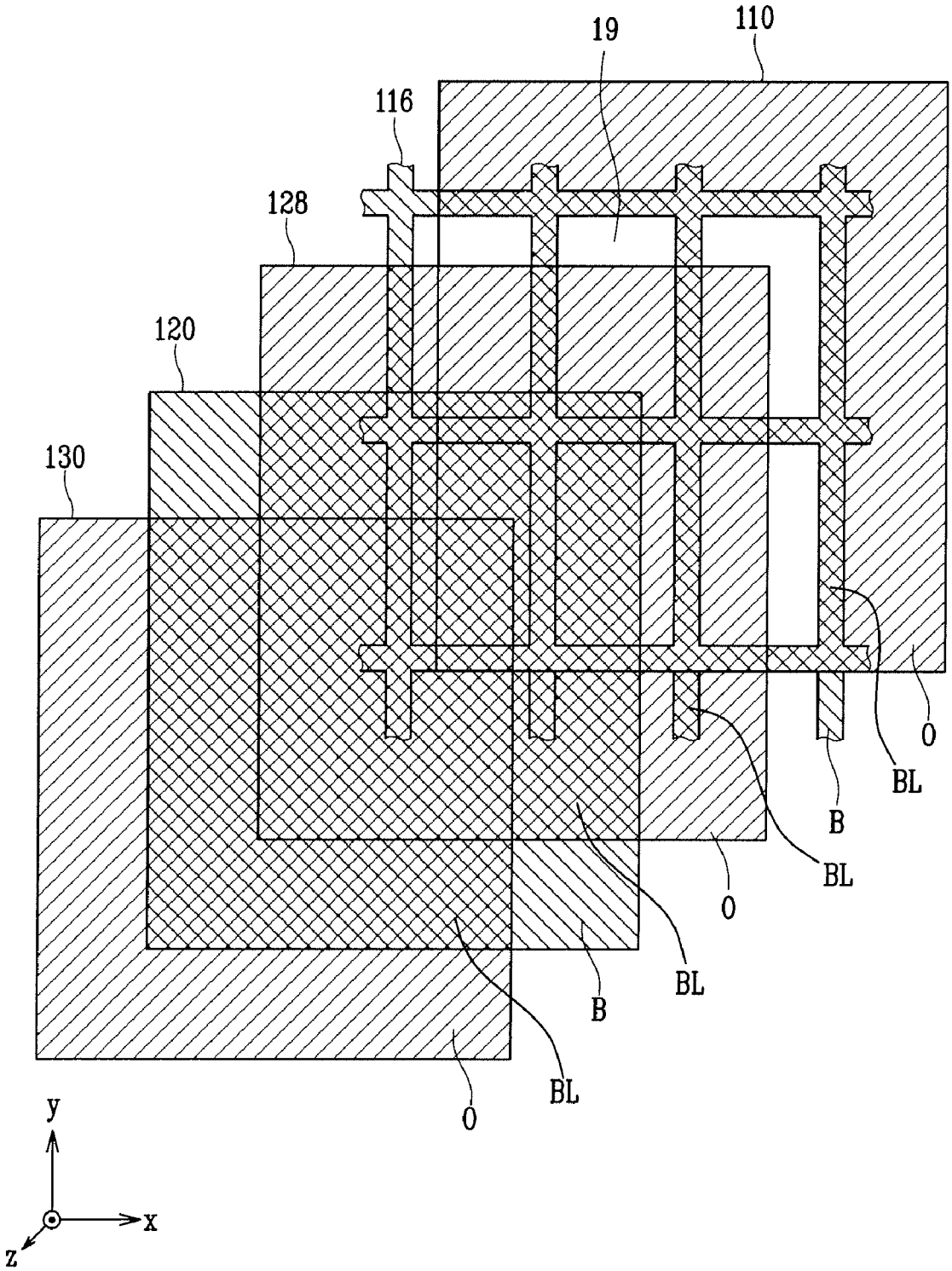
FIG. 6 is a schematic view illustrating a subtractive color mixing state when a filter, a front substrate, an upper dielectric layer, barrier ribs, and a rear substrate of the plasma display panel of FIG. 5 are overlapped with each other.

FIG. 6 is a top plane view illustrating a subtractive color mixing state when the filter, front substrate, upper dielectric layer, barrier ribs, and front substrate of the plasma display panel of the present embodiment are overlapped with each other.

Referring to FIG. 6, when the plasma display panel of this embodiment is viewed from a front side, the adjacent colors of the filter 130, front substrate 120, upper dielectric layer 128, barrier ribs 116, and rear substrate 110 are subtractive-mixed with each other through the quadruple complementary coloring.

That is, the fifth color (orange color O) of the filter 130 is primarily complementary with the first color (blue color) of the front substrate 120 to realize the subtractive color mixture, thereby together appearing as a black color BL.

In addition, the first color (blue color B) of the front substrate 120 is secondarily complementary with the fourth color (orange color O) of the upper dielectric layer 128 to realize the subtractive color mixture, thereby together appearing as the black color BL.

Further, the fourth color (orange color O) of the upper dielectric layer 128 is thirdly complementary with the third color (blue color B) of the barrier ribs 116 to realize the subtractive color mixture, thereby together appearing as the black color BL.

The third color (blue color B) of the barrier ribs 116 is fourthly complementary with the second color (orange color O) of the rear substrate 110 to realize the subtractive color mixture, thereby together appearing as the black color BL.

As described above, in the plasma display panel of the second exemplary embodiment, the adjacent colors of the filter 130, front substrate 120, upper dielectric layer 128, barrier ribs 116 and rear substrate 110 are subtractive-mixed with each other through the quadruple complementary coloring, thereby together appearing as the black color BL. Therefore, the external light absorption rate increases and the external light reflection can be reduced or prevented.

Therefore, the quadruple complementary color plasma display panel of this second exemplary embodiment further reduces the external light reflection as compared with the triple complementary color plasma display panel of the first exemplary embodiment, thereby further improving the room contrast and display quality thereof.

The following will describe a plasma display panel according to a third exemplary embodiment of the present invention with reference to the accompanying drawings. In the third exemplary embodiment, the same or like parts as those of the first exemplary embodiment will be assigned with the same reference numbers and a detailed description thereof will be omitted herein.

Figure 7:
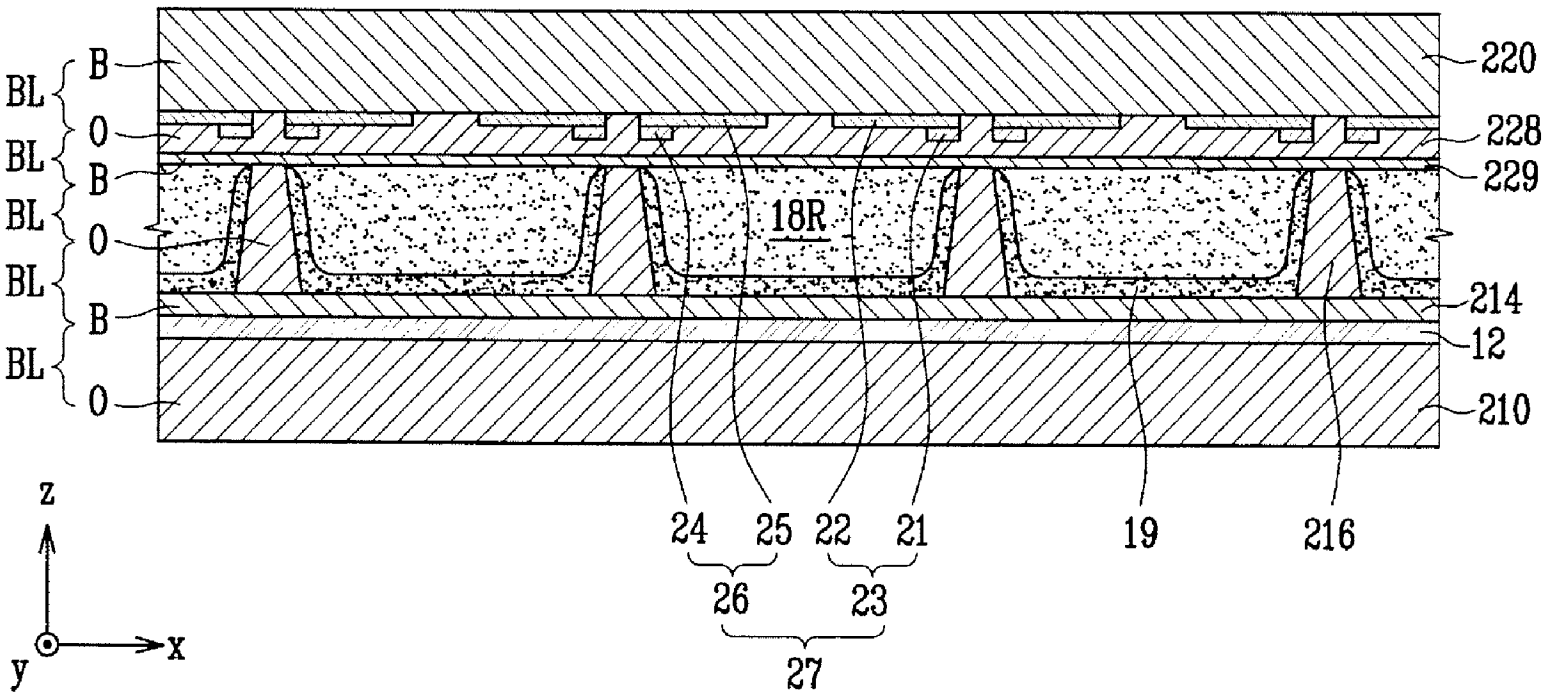
FIG. 7 is a sectional view of a plasma display panel according to a third exemplary embodiment of the present invention.

FIG. 7 is a sectional view of a plasma display panel according to the third exemplary embodiment of the present invention.

Referring to FIG. 7, a plasma display panel includes front and rear substrates 220 and 210 facing each other. The front and rear substrates 220 and 210 are respectively colored with first and second colors.

The first and second colors may be respectively a blue color B and an orange color O that is complementary with the blue color B. Barrier ribs 216 are colored with the third color (e.g., an orange color O) that is identical to the second color.

An upper dielectric layer 228 covering display electrodes 27 on the front substrate 220 is colored with a fourth color (e.g., the orange color O) that is identical to the second and third colors.

A passivation layer 229 covering the upper dielectric layer 228 is colored with a fifth color (e.g., the blue color B) that is identical to the first color.

The passivation layer 229 may be colored by depositing a coloring agent such as manganese (Mn), nickel (Ni) or cobalt (Co) during a process for depositing a MgO on the upper dielectric layer 228.

A lower dielectric layer 214 covering address electrodes 12 on the rear substrate 210 is colored with a sixth color (e.g., the blue color B).

The lower dielectric layer 214 may be formed of a dielectric substance mixed with a blue coloring agent such as the manganese (Mn), nickel (Ni) or cobalt (Co).

Accordingly, the plasma display panel of the third exemplary embodiment can realize a subtractive color mixture through the quintuple complementary coloring between the colors of the front substrate 220, upper dielectric layer 228, passivation layer 229, barrier ribs 216, lower dielectric layer 214 and rear substrate 210.

That is, the first color (blue color B) of the front substrate 220 is firstly complementary with the fourth color (orange color O) of the dielectric layer 228. The fourth color (orange color O) of the upper dielectric layer 228 is secondarily complementary with the fifth color (blue color B) of the passivation layer 229.

In addition, the fifth color (blue color B) of the passivation layer 229 is thirdly complementary with the third color (orange color O) of the barrier ribs 216 and the third color (orange color O) of the barrier ribs 216 is fourthly complementary with the sixth color (blue color B) of the lower dielectric layer 214.

Further, the sixth color (blue color B) of the lower dielectric layer 214 is fifthly complementary with the second color (orange color O) of the rear substrate 210.

In this embodiment, the front substrate 220, passivation layer 229 and lower dielectric layer 214 are colored with the blue color and the rear substrate 210, barrier ribs 216 and upper dielectric layer 228 are colored with the orange color.

However, the present invention is not limited to the above case. For instance, in other embodiments, the front substrate 220, passivation layer 229 and lower dielectric layer 214 may be colored with the orange color while the rear substrate 210, barrier ribs 216 and upper dielectric layer 228 may be colored with the blue color. In addition, a variety of other colors that are complementary with each other may be applied.

Figure 8:
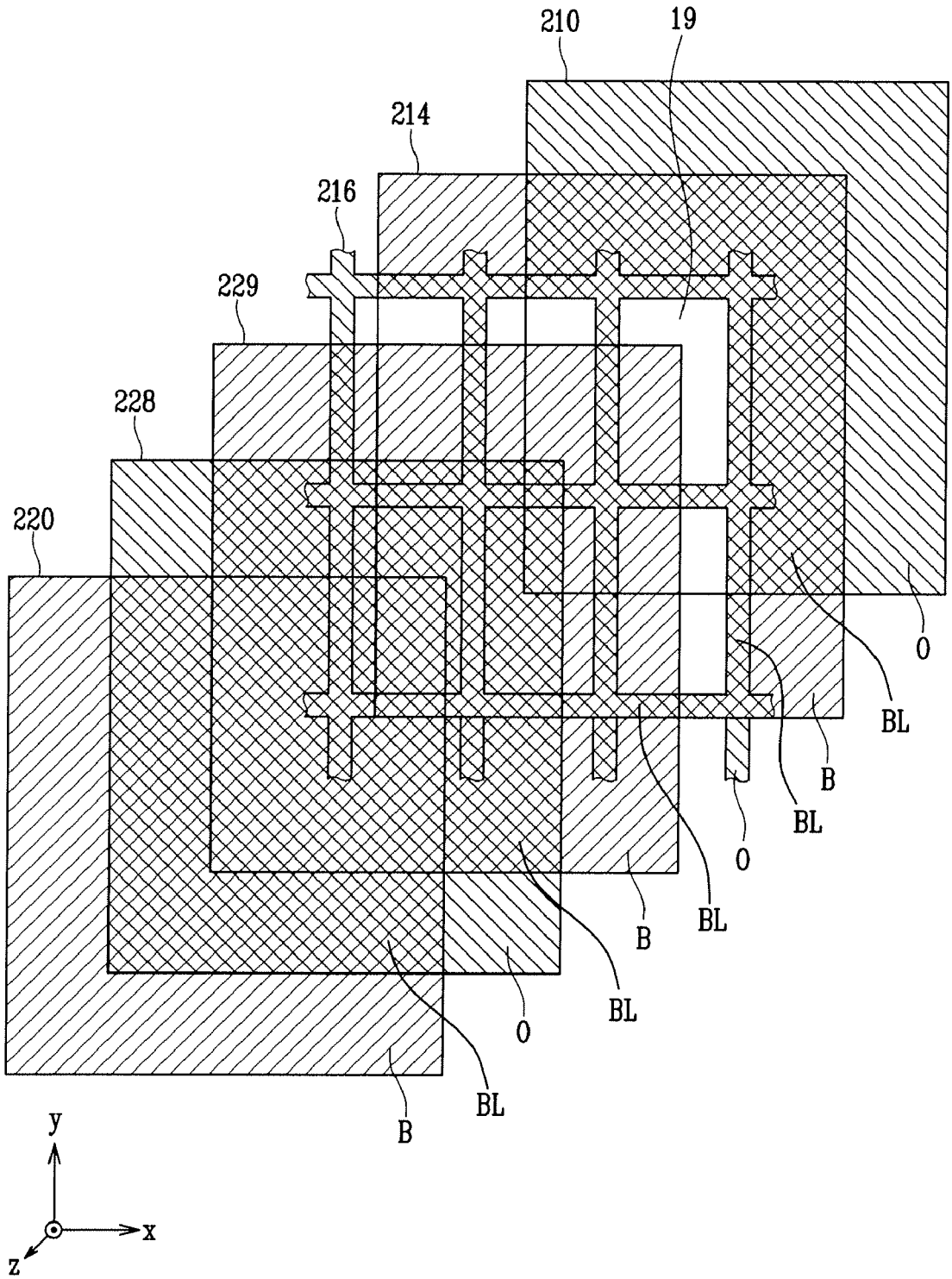
FIG. 8 is a schematic view illustrating a subtractive color mixing state when a front substrate, an upper dielectric layer, a passivation layer, barrier ribs, a lower dielectric layer, and a rear substrate of the plasma display panel of FIG. 7 are overlapped with each other.

FIG. 8 is a schematic view illustrating a subtractive color mixing state when the front substrate, upper dielectric layer, passivation layer, barrier ribs, lower dielectric layer, and rear substrate of the plasma display panel of the present embodiment are overlapped with each other.

Referring to FIG. 8, when the plasma display panel of this embodiment is viewed from a front side, the adjacent colors of the front substrate 220, upper dielectric layer 228, passivation layer 229, barrier ribs 216, lower dielectric layer 214, and rear substrate 210 are subtractive-mixed with each other through the quintuple complementary coloring.

That is, the first color (blue color B) of the front substrate 220 is firstly complementary with the fourth color (orange color O) of the dielectric layer 228 to realize the subtractive color mixture, thereby together appearing as a black color BL.

In addition, the fourth color (orange color O) of the upper dielectric layer 228 is secondarily complementary with the fifth color (blue color B) of the passivation layer 229 to realize the subtractive color mixture, thereby together appearing as the black color BL.

Further, the fifth color (blue color B) of the passivation layer 229 is thirdly complementary with the third color (orange color O) of the barrier ribs 216 to realize the subtractive color mixture, thereby together appearing as the black color BL.

The third color (orange color O) of the barrier ribs 216 is fourthly complementary with the sixth color (blue color B) of the lower dielectric layer to realize the subtractive color mixture, thereby together appearing as the black color BL.

Further, the sixth color (blue color B) of the lower dielectric layer is fifthly complementary with the second color (orange color O) of the rear substrate 210 to realize the subtractive color mixture, thereby together appearing as the black color BL.

As described above, in the plasma display panel of the present embodiment, the adjacent colors of the front substrate 220, upper dielectric layer 228, barrier ribs 216, and rear substrate 210 are subtractive-mixed with each other through the quintuple complementary coloring, thereby together appearing as the black color BL. Therefore, the external light absorption rate increases and the external light reflection is reduced or prevented.

Therefore, the quintuple complementary color plasma display panel of the third exemplary embodiment further reduces the external light reflection as compared with the quadruple complementary color plasma display panel of the second exemplary embodiment, thereby further improving the room contrast and display quality thereof The following will describe a plasma display panel according to a fourth exemplary embodiment of the present invention with reference to the accompanying drawings. In the third exemplary embodiment, the same or like parts as those of the first and second exemplary embodiments will be assigned with the same reference numbers and the detailed description thereof will be omitted herein.

Figure 9:
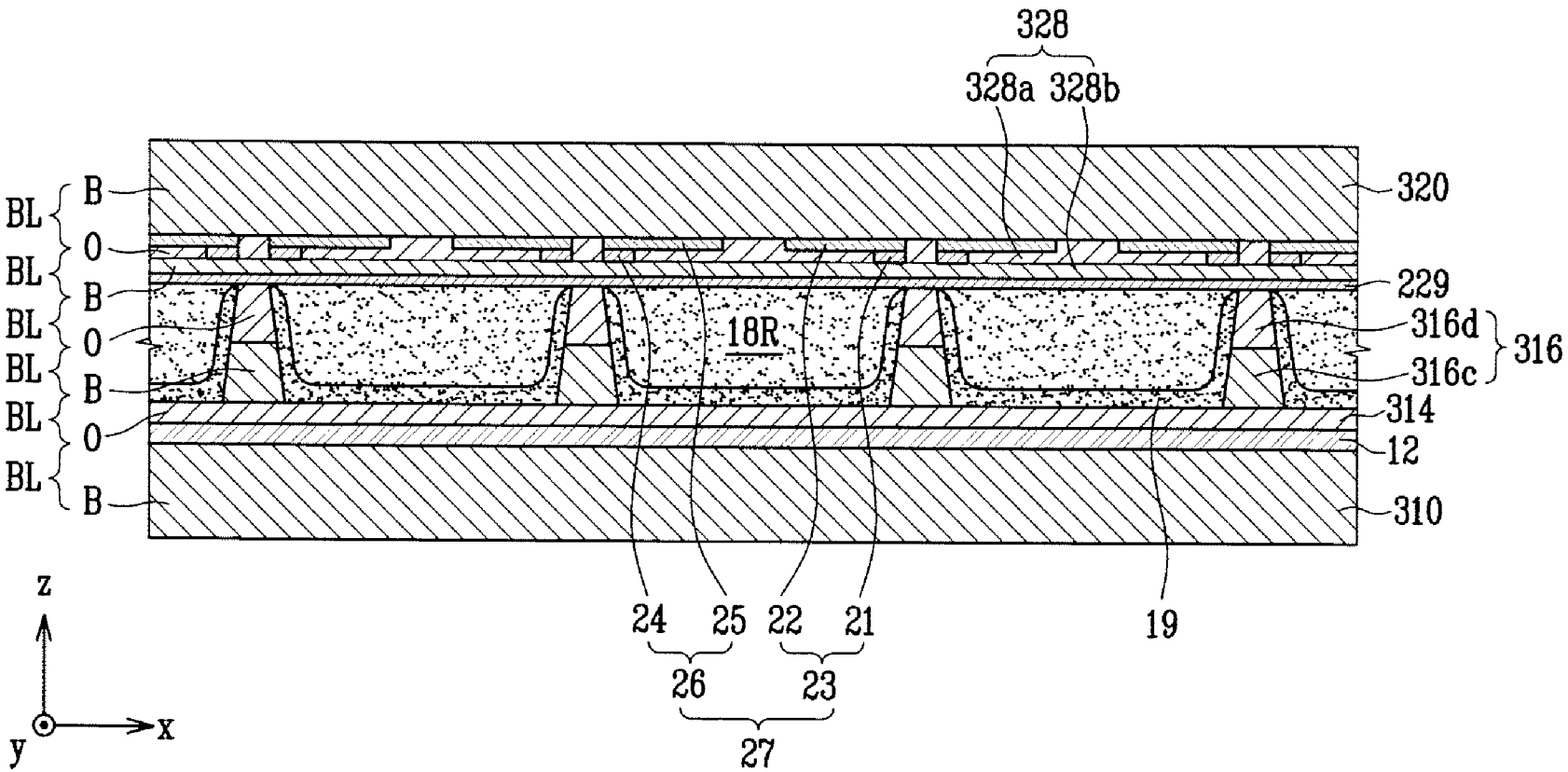
FIG. 9 is a sectional view of a plasma display panel according to a fourth exemplary embodiment of the present invention.

FIG. 9 is a sectional view of a plasma display panel according to a fourth exemplary embodiment of the present invention.

Referring to FIG. 9, a plasma display panel includes front and rear substrates 320 and 310 facing each other. The front and rear substrates 320 and 310 are respectively colored with first and second colors. In one embodiment, both of the first and second colors may be a blue color B.

Barrier ribs 316 are formed by a first barrier rib layer 316*c* contacting a lower dielectric layer 314 and a second barrier rib layer 316*d* formed on the first barrier rib layer 316*c*.

The first barrier rib layer 316*c* is colored with a third color (e.g., a blue color (B)). The second barrier rib layer 316*d* is colored with a fourth color (e.g., an orange color O).

In one embodiment, the barrier ribs 316 are formed by (a) forming the first barrier rib layer 316*c* by depositing and drying dielectric paste on the lower dielectric layer 314, (b) forming the second barrier rib layer 316*d* by depositing and drying dielectric paste on the first barrier rib layer 316*c*, and (c) patterning the first and second barrier rib layers 316*c* and 316*d*.

At this point, the dielectric paste for the first barrier rib layer 316*c* may be mixed with a blue coloring agent such as manganese (Mn), nickel (Ni) or cobalt (Co).

In addition, the dielectric paste for the second barrier rib layer 316*d* may be mixed with an orange color coloring agent such as copper (Cu), antimony (Sb) or chrome (Cr).

An upper dielectric layer 328 includes a first upper dielectric layer 328*a* contacting the front substrate 320 and a second upper dielectric layer 328*b* formed on the first upper dielectric layer 328*a*.

The first upper dielectric layer 328*a* is colored with a fifth color (e.g., blue color B) and the second upper dielectric layer 328*b* is colored with a sixth color (e.g., orange color O).

A lower dielectric layer 314 covering address electrodes 12 on the rear substrate 310 is colored with a seventh color (e.g., blue color B).

Accordingly, the plasma display panel of the present embodiment can realize a subtractive color mixture through the six-fold complementary coloring between the colors of the front substrate 320, first upper dielectric layer 328*a*, second upper dielectric layer 328*b*, second barrier rib layer 316*d*, first barrier rib layer 316*c*, lower dielectric layer 314, and rear substrate 310.

That is, the first color (blue color B) of the front substrate 320 is firstly complementary with the fifth color (orange color O) of the first upper dielectric layer 328*a*. The fifth color (orange color O) of the first upper dielectric layer 328*a* is secondarily complementary with the sixth color (blue color B) of the second upper dielectric layer 328*b*.

In addition, the sixth color (blue color B) of the second upper dielectric layer 328*b* is thirdly complementary with the fourth color (orange color O) of the second barrier rib layer 316*d* and the fourth color (orange color O) of the second barrier rib layer 316*d* is fourthly complementary with the third color (blue color B) of the first barrier rib layer 316*c*.

Further, the third color (blue color B) of the first barrier rib layer 316*c* is fifthly complementary with the seventh color (orange color O) of the lower dielectric layer 314. The seventh color (orange color O) of the lower dielectric layer 314 is sixthly complementary with the second color (blue color B) of the rear substrate 310.

As described above, the first, fifth, sixth, fourth, third, seventh, and second colors are subtractive-mixed with each other through the six-fold complementary coloring.

In this embodiment, the front substrate 320, second upper dielectric layer 328*b*, first barrier rib layer 316*c*, and rear substrate 310 are colored with the blue color and the first upper dielectric layer 328*a*, second barrier rib layer 316*d*, and lower dielectric layer 314 are colored with the orange color.

However, the present invention is not limited to the above case. For instance, in other embodiments, the front substrate 320, second upper dielectric layer 328*b*, first barrier rib layer 316*c*, and rear substrate 310 may be colored with the orange color and the first upper dielectric layer 328*a*, second barrier rib layer 316*d*, and lower dielectric layer 314 may be colored with the blue color. In addition, a variety of other colors that are complementary with each other may be applied.

Figure 10:
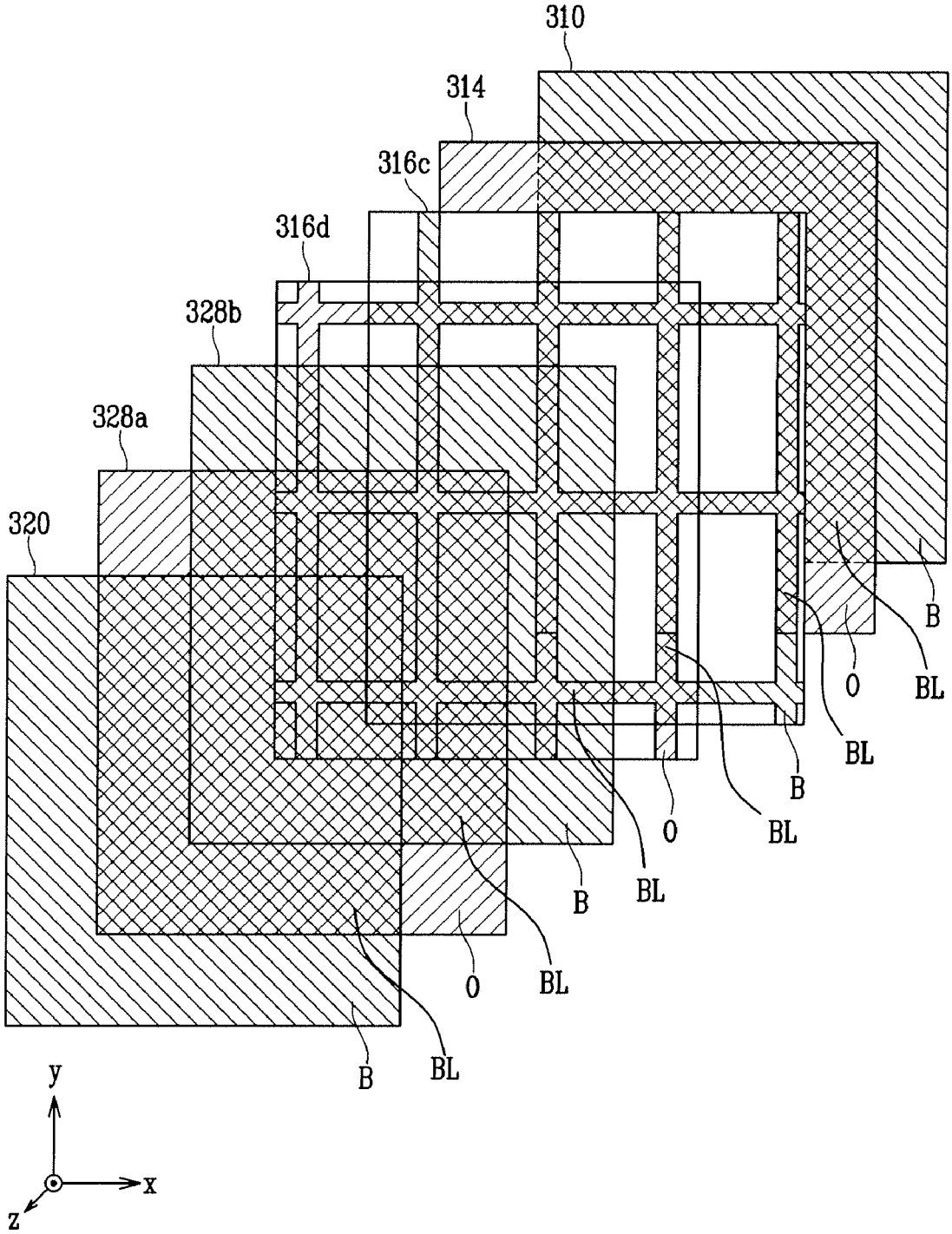
FIG. 10 is a schematic view illustrating a subtractive color mixing state when a front substrate, a first upper dielectric layer, a second upper dielectric layer, a first barrier rib layer, a second barrier rib layer, a lower dielectric layer, and a rear substrate of the plasma display panel of FIG. 9 are overlapped with each other.

FIG. 10 is a schematic view illustrating a subtractive color mixing state when the front substrate 320, first and second upper dielectric layers 328*a*, 328*b*, first and second barrier rib layers 316*c*, 316*d*, lower dielectric layer 314, and rear substrate 310 of the plasma display panel of the present embodiment are overlapped with each other.

Referring to FIG. 10, when the plasma display panel of the fourth exemplary embodiment is viewed from a front side, the adjacent colors of the front substrate 320, first upper dielectric layer 328*a*, second upper dielectric layer 328*b*, second barrier rib layer 316*d*, first barrier rib layer 316*c*, lower dielectric layer 314, and rear substrate 310 are subtractive-mixed with each other through the six-fold complementary coloring.

That is, the first color (blue color B) of the front substrate 320 is firstly complementary with the fifth color (orange color O) of the first upper dielectric layer 328*a* to realize the subtractive color mixture, thereby together appearing as a black color BL.

In addition, the fifth color (orange color O) of the first upper dielectric layer 328*a* is secondarily complementary with the sixth color (blue color B) of the second upper dielectric layer 328*b* to realize the subtractive color mixture, thereby together appearing as the black color BL.

Further, the sixth color (blue color B) of the second upper dielectric layer 328*b* is thirdly complementary with the fourth color (orange color O) of the second barrier rib layer 316*d* to realize the subtractive color mixture, thereby together appearing as the black color BL.

The fourth color (orange color O) of the second barrier rib layer 316*d* is fourthly complementary with the third color (blue color B) of the first barrier rib layer 316*c* to realize the subtractive color mixture, thereby together appearing as the black color BL.

Further, the third color (blue color B) of the first barrier rib layer 316*c* is fifthly complementary with the seventh color (orange color O) of the lower dielectric layer 314 to realize the subtractive color mixture, thereby together appearing as the black color BL.

In addition, the seventh color (orange color O) of the lower dielectric layer 314 is sixthly complementary with the second color (blue B) of the rear substrate 310 to realize the subtractive color mixture, thereby together appearing as the black color BL.

As described above, in the plasma display panel of the present embodiment, the adjacent colors of the front substrate 220, first and second upper dielectric layers 328*a* and 328*b*, first and second barrier rib layers 316*c* and 316*d*, lower dielectric layer 314, and rear substrate 310 are subtractive-mixed with each other through the six-fold complementary coloring, thereby together appearing as the black color BL. Therefore, the external light absorption rate increases and the external light reflection is reduced or prevented.

Therefore, the six-fold complementary color plasma display panel of this second exemplary embodiment further reduces the external light reflection as compared with the quintuple complementary color plasma display panel of the third exemplary embodiment, thereby further improving the room contrast and display quality thereof The following table 1 shows a test result of an external light reflection luminance and a room contrast of a conventional non-complementary color plasma display panel and multiple complementary color plasma display panels according to the first through fourth exemplary embodiments.

TABLE 1

| | | External light reflection luminance (cd/m2) | Room contrast |
|---|---|---|---|
| Conventional art | Non-complementary color | 15.2 | 70:1 |
| Present invention | Triple complementary color | 6.6 | 151:1 |
| | Quadruple complementary color | 5.8 | 172:1 |
| | Quintuple complementary color | 5.2 | 192:1 |
| | Six-fold complementary color | 4.7 | 212:1 |

Referring to Table 1, the external light reflection luminance of the conventional non-complementary color plasma display panel was 15.26 cd/m$^2$ while the external light reflection luminance of the triple complementary color plasma display panel of the first embodiment of the present invention was 6.6 cd/m$^2$.

That is, the external light reflection luminance of the triple complementary color plasma display panel of the first embodiment of the present invention was reduced by more than two times as compared with that of the conventional non-complementary color plasma display panel.

Therefore, the room contrast of the triple complementary color plasma display panel of the first embodiment increased up to 151:1 while that of the conventional non-complementary color plasma display panel was 70:1.

The external light reflection luminance of the quadruple, quintuple and six-fold complementary color plasma display panels were reduced by a factor with respect to the triple complementary color plasma display panel. As a result, the room contrast thereof gradually increased.

As described above, the plasma display panel of the present invention can reduce the external light reflection luminance using the subtractive color mixture through the multiple complementary coloring and thus increase the room contrast, thereby enhancing the display quality thereof.

In addition, since the adhesive layer, the substrates, the dielectric layer, and the barrier ribs are colored with colors that can realize the complementary color, the plasma display panel of the present invention absorbs the external light through the subtractive color mixture and reduces the external light reflection luminance without using the external light reflection preventing layer and the black stripe. Therefore, the productivity can be improved.

Figure 11:
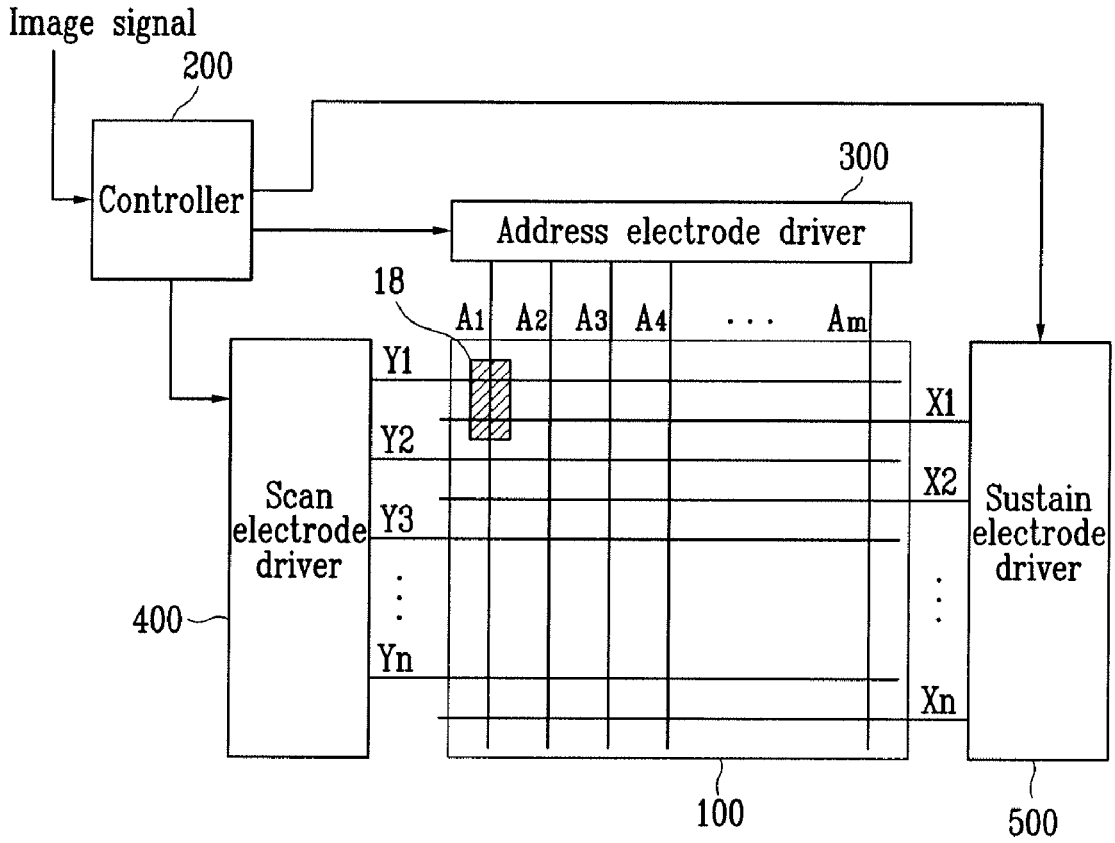
FIG. 11 is a block diagram of a plasma display device incorporating any one of the plasma display panels of exemplary embodiments according to the present invention.

Referring now to FIG. 11, a plasma display device according to an exemplary embodiment of the present invention includes a plasma display panel (PDP) 100, a controller 200, an address electrode driver 300, a scan electrode driver 400, and a sustain electrode driver 500. The scan electrode driver 400 and/or the sustain electrode driver 500 may also be referred to as a display electrode driver, either individually or together. The PDP 100 may be any one of the PDPs disclosed in FIGS. 1-10 according to embodiments of the present invention.

The PDP 100 includes a plurality of address electrodes A1 to Am (hereinafter, referred to as "A electrodes") extending in a column direction, and a plurality of sustain and scan electrodes X1 to Xn and Y1 to Yn (hereinafter, referred to as "X electrodes" and "Y electrodes") extending in a row direction in pairs. The X electrodes and the Y electrodes may also be referred to as display electrodes. In general, the X electrodes X1 to Xn respectively correspond to the Y electrodes Y1 to Yn, and the Y and X electrodes Y1 to Yn and X1 to Xn are arranged to cross the A electrodes A1 to Am. In this case, a discharge space at a crossing region of the A electrodes A1 to Am and the X and Y electrodes X1 to Xn and Y1 to Yn forms a discharge cell 110.

The controller 200 receives an external video signal, outputs driving control signals, divides a frame into a plurality of subfields having respective brightness weight values, and drives them. Each subfield has at least an address period and a sustain period. The A, X, and Y electrode drivers 300, 400, 500 respectively apply driving voltages to the A electrodes A1 to Am, the X electrodes X1 to Xn, and the Y electrodes Y1 to Yn in response to the driving control signals from the controller 200. The driving voltages provided to the A electrodes may also be referred to as address signals the driving voltages provided to the X electrodes and the Y electrodes may also be referred to as display signals, which may include sustain signals and/or scan signals.

Although exemplary embodiments of the present invention have been described in detail hereinabove, it should be clearly understood that many variations and/or modifications of the basic inventive concept taught herein still fall within the spirit and scope of the present invention, as defined by the appended claims and their equivalents.

By way of example, while the embodiments of the present invention are described herein primarily in reference to subtractive-mixing of complementary colors of adjacent layers that together appear as black, in the described and/or other embodiments, the subtractive-mixed colors may together appear as substantially black, similar to black, dark blue, dark gray or any other dark color adapted to reduce or prevent the reflection of external light incident on the plasma display panel. Therefore, the colors (e.g., chromatic colors) of adjacent layers may not necessarily be complementary to each other in these embodiments, but may instead be almost complementary, substantially complementary or have any other suitable relationship with each other so as to produce suitable dark color for reducing or preventing reflection of external light.

What is claimed is:

1. A plasma display panel comprising:

a front substrate having a first color;

a rear substrate facing the front substrate;

barrier ribs disposed between the front and rear substrates and defining discharge cells, the barrier ribs having a second color;

phosphor layers disposed in the discharge cells;

display electrodes arranged on the front substrate and extending in a first direction, the display electrodes corresponding to the discharge cells;

a dielectric layer disposed on the front substrate and covering the display electrodes, the dielectric layer having a third color;

address electrodes arranged on the rear substrate and extending in a second direction crossing the first direction, the address electrodes corresponding to the discharge cells; and a filter disposed on the front substrate and having a fourth color, wherein a subtractive color mixture is realized by combination of the first, second, third and fourth colors.

2. The plasma display panel of claim 1, wherein at least one of the first color, the second color, the third color, or the fourth color is a chromatic color.

3. The plasma display panel of claim 1, wherein adjacent said colors among the first, second, third and fourth colors are complementary with each other.

4. The plasma display panel of claim 3, wherein the first and second colors are respectively complementary with the fourth and third colors.

5. The plasma display panel of claim 3, wherein the first and second colors are a blue color and the third and fourth colors are an orange color.

6. The plasma display panel of claim 5, wherein the front substrate and the barrier ribs each comprise at least one of manganese (Mn), nickel (Ni), or cobalt (Co).

7. The plasma display panel of claim 5, wherein the filter and the dielectric layer each comprise at least one of copper (Cu), antimony (Sb), or chrome (Cr).

8. The plasma display panel of claim 1, wherein the filter comprises:

an electromagnetic shielding conductive layer;

a protective filter covering the electromagnetic shielding conductive layer; and adhesive layers adhering the electromagnetic shielding conductive layer and the protective filter to each other and adhering the electromagnetic shielding conductive layer to the front substrate, the adhesive layers being colored such that the filter has the fourth color.

9. The plasma display panel of claim 8, wherein the adhesive layers comprise at least one of copper (Cu), antimony (Sb), or chrome (Cr).

10. A plasma display panel comprising:

a front substrate having a first color;

a rear substrate facing the front substrate, the rear substrate having a second color;

barrier ribs disposed between the front and rear substrates and defining discharge cells, the barrier ribs having a third color;

phosphor layers disposed in the discharge cells;

display electrodes arranged on the front substrate and extending in a first direction, the display electrodes corresponding to the discharge cells;

a dielectric layer disposed on the front substrate and covering the display electrodes, the dielectric layer having a fourth color;

address electrodes arranged on the rear substrate and extending in a second direction crossing the first direction, the address electrodes corresponding to the discharge cells; and a filter disposed on the front substrate and having a fifth color, wherein a subtractive color mixture is realized by combination of the first, second, third, fourth and fifth colors.

11. The plasma display panel of claim 10, wherein at least one of the first color, the second color, the third color, the fourth color, or the fifth color is a chromatic color.

12. The plasma display panel of claim 10, wherein adjacent said colors among the first, second third, fourth and fifth colors are complementary with each other.

13. The plasma display panel of claim 12, wherein the first and third colors are respectively complementary with the second, fourth and fifth colors.

14. The plasma display panel of claim 13, wherein the first and third colors are a blue color and the second, fourth and fifth colors are an orange color.

15. The plasma display panel of claim 14, wherein the front substrate and the barrier ribs each comprise at least one of manganese (Mn), nickel (Ni), or cobalt (Co).

16. The plasma display panel of claim 14, wherein the filter and the dielectric layer each comprise at least one of copper (Cu), antimony (Sb), or chrome (Cr).

17. The plasma display panel of claim 10, wherein the filter comprises:

an electromagnetic shielding conductive layer;

a protective filter covering the electromagnetic shielding conductive layer; and adhesive layers adhering the electromagnetic shielding conductive layer and the protective filter to each other and adhering the electromagnetic shielding conductive layer to the front substrate, the adhesive layers being colored such that the filter has the fifth color.

18. The plasma display panel of claim 17, wherein the adhesive layers comprise at least one of copper (Cu), antimony (Sb), or chrome (Cr).

19. A plasma display panel comprising:

a front substrate having a first color;

a rear substrate facing the front substrate, the rear substrate having a second color;

barrier ribs disposed between the front and rear substrates and defining discharge cells, the barrier ribs having a third color;

phosphor layers disposed in the discharge cells;

display electrodes arranged on the front substrate and extending in a first direction, the display electrodes corresponding to the discharge cells;

an upper dielectric layer disposed on the front substrate and covering the display electrodes, the upper dielectric layer having a fourth color;

a passivation layer covering the upper dielectric layer and having a fifth color;

address electrodes arranged on the rear substrate and extending in a second direction crossing the first direction, the address electrodes corresponding to the discharge cells; and a lower dielectric layer covering the address electrodes on the rear substrate and having a sixth color, wherein a subtractive color mixture is realized by combination of the first, second, third, fourth, fifth and sixth colors.

20. The plasma display panel of claim 19, wherein at least one of the first color, the second color, the third color, the fourth color, the fifth color, or the sixth color is a chromatic color.

21. The plasma display panel of claim 19, wherein adjacent said colors among the first, second, third, fourth, fifth and sixth colors are complementary with each other.

22. The plasma display panel of claim 21, wherein the first, fifth and sixth colors are respectively complementary with the second, third and fourth colors.

23. The plasma display panel of claim 22, wherein the first, fifth and sixth colors are a blue color and the second, third and fourth colors are an orange color.

24. The plasma display panel of claim 23, wherein the front substrate, the passivation layer and the lower dielectric layer each comprise at least one of manganese (Mn), nickel (Ni), or cobalt (Co).

25. The plasma display panel of claim 23, wherein the rear substrate, the upper dielectric layer and the barrier ribs each comprise at least one of copper (Cu), antimony (Sb), or chrome (Cr).

26. A plasma display panel comprising:

a front substrate having a first color;

a rear substrate facing the front substrate, the rear substrate having a second color;

barrier ribs disposed between the front and rear substrates, the barrier ribs defining discharge cells;

phosphor layers disposed in the discharge cells;

display electrodes arranged on the front substrate and extending in a first direction, the display electrodes corresponding to the discharge cells;

an upper dielectric layer disposed on the front substrate and covering the display electrodes;

address electrodes arranged on the rear substrate and extending in a second direction crossing the first direction, the address electrodes corresponding to the discharge cells; and a lower dielectric layer covering the address electrodes on the rear substrate, the lower dielectric layer having a third color wherein the barrier ribs comprise a first barrier rib layer contacting the lower dielectric layer and having a fourth color and a second barrier rib layer disposed on the first barrier rib layer and having a fifth color, the upper dielectric layer comprises a first upper dielectric layer contacting the front substrate and having a sixth color and a second upper dielectric layer covering the first upper dielectric layer and having a seventh color, wherein a subtractive color mixture is realized by combination of the first, second, third, fourth, fifth, sixth, and seventh colors.

27. The plasma display panel of claim 26, wherein at least one of the first color, the second color, the third color, the fourth color, the fifth color, the sixth color, or the seventh color is a chromatic color.

28. The plasma display panel of claim 26, wherein adjacent said colors among the first, second, third, fourth, fifth, sixth, and seventh colors are complementary with each other.

29. The plasma display panel of claim 28, wherein the first, second, third, and sixth colors are respectively complementary with the fourth, fifth and seventh colors.

30. The plasma display panel of claim 29, wherein the first, second, third, and sixth colors are a blue color and the fourth, fifth and seventh colors are an orange color.

31. The plasma display panel of claim 30, wherein the front substrate, the rear substrate, the first barrier layers, and the second upper dielectric layer each comprise at least one of manganese (Mn), nickel (Ni), or cobalt (Co).

32. The plasma display panel of claim 30, wherein the second barrier rib layer, the first upper dielectric layer and the lower dielectric layer each comprise at least one of copper (Cu), antimony (Sb), or chrome (Cr).

33. A plasma display device comprising a plasma display panel, and further comprising:

an address electrode driver adapted to provide address signals to the plasma display panel;

at least one display electrode driver adapted to provide display signals to the plasma display panel; and a controller adapted to convert a video signal to driving control signals and to provide the driving control signals to the address electrode driver and said at least one display electrode driver, wherein the plasma display panel comprises:

a front substrate having a first chromatic color;

a rear substrate facing the front substrate;

barrier ribs disposed between the front and rear substrates and defining discharge cells, the barrier ribs comprising at least one barrier rib layer having a second chromatic color;

phosphor layers disposed in the discharge cells;

display electrodes arranged on the front substrate and extending in a first direction, the display electrodes corresponding to the discharge cells;

an upper dielectric layer disposed on the front substrate and covering the display electrodes, the upper dielectric layer comprising at least one dielectric layer having a third chromatic color; and address electrodes arranged on the rear substrate and extending in a second direction crossing the first direction, the address electrodes corresponding to the discharge cells, wherein adjacent colors among the chromatic colors are subtractive-mixed with each other to appear black, substantially black or other dark color adapted to reduce or prevent reflection of external light incident on the plasma display panel.

34. The plasma display device of claim 33, wherein the rear substrate has a fourth chromatic color that is subtractive-mixed with an adjacent color among the chromatic colors to appear black, substantially black or said other dark color.

35. The plasma display device of claim 33, wherein the plasma display panel further comprises a filter disposed on the front substrate and having a fourth chromatic color that is subtractive-mixed with the first chromatic color of the front substrate to appear black, substantially black, or said other dark color.

* * * * *